US007193575B2

(12) United States Patent
Mohammadian

(10) Patent No.: US 7,193,575 B2
(45) Date of Patent: Mar. 20, 2007

(54) WIDEBAND ANTENNA WITH TRANSMISSION LINE ELBOW

(75) Inventor: Alireza Hormoz Mohammadian, San Diego, CA (US)

(73) Assignee: Qualcomm Incorporated, San Diego, CA (US)

( * ) Notice: Subject to any disclaimer, the term of this patent is extended or adjusted under 35 U.S.C. 154(b) by 5 days.

(21) Appl. No.: 10/819,558

(22) Filed: Apr. 7, 2004

(65) Prior Publication Data

US 2004/0212537 A1 Oct. 28, 2004

Related U.S. Application Data

(60) Provisional application No. 60/465,664, filed on Apr. 25, 2003.

(51) Int. Cl.
*H01Q 1/24* (2006.01)
*H01Q 1/38* (2006.01)
*H01Q 13/10* (2006.01)

(52) U.S. Cl. ..... 343/767; 343/702; 455/575.7

(58) Field of Classification Search ..... 343/702, 343/767, 795, 770; 455/575.7
See application file for complete search history.

(56) References Cited

U.S. PATENT DOCUMENTS 4,298,878 A * 11/1981 Dupressoir et al. ..... 343/795
4,500,887 A * 2/1985 Nester ..... 343/700 MS
4,723,305 A * 2/1988 Phillips et al. ..... 455/575.7
6,366,254 B1 * 4/2002 Sievenpiper et al. ..... 343/770
6,703,985 B2 * 3/2004 Lee ..... 343/786

FOREIGN PATENT DOCUMENTS

DE 40 03 955 C1 4/1991

OTHER PUBLICATIONS

Van Heuven, "A New Integrated Waveguide-Microstrip Transition," IEEE Transactions on Microwave Theory and Techniques, Mar. 1976, pp. 144-147.
Langley et al., "Multi-Octave Phased Array for Circuit Integration Using Balanced Antipodal Vivaldi Antenna Elements," Antennas and Propagation Society International Symposium, 1995. AP-S. Digest, vol. 1, Jun. 18-23, 1995 pp. 178-181.

(Continued)

*Primary Examiner*—Michael C. Wimer
(74) *Attorney, Agent, or Firm*—Sandra L. Godsey; Thien T. Nguyen; Thomas R. Rouse

(57) ABSTRACT

An antenna (100) includes overlapping conductive plates (102, 104) having a radiating end (112) and a feed end (114). The plates include partially overlapping edges (106) that flare away from each other as each edge progresses toward the radiating end (112). A dual conductor microstrip feed (110) is also provided. A transmission line (108) connects each plate to a different conductor (113, 115) of the microstrip feed. The transmission line comprises two substantially overlapping, parallel conductive ribbons (130, 131) that form an elbow (107) with a prescribed turn (109).

18 Claims, 4 Drawing Sheets

OTHER PUBLICATIONS

Fourikis et al., "Parametric study of the co- and crosspolarisation characteristics of tapered planar and antipodal slotline antennas," IEE Proceedings-H, vol. 140, No. 1, Feb. 1993, pp. 17-22.

Langely et al., "Balanced antipodal Vivaldi antenna for wide bandwidth phased arrays," IEE Proc.-Microw. Antennas Propag., vol. 143, No. 2, Apr. 1996, pp. 97-102.

Ehud Gazit, "Improved design of the Vivaldi antenna," IEE Proceedings, vol. 135, Pt. H, No. 2, Apr. 1988, pp. 89-92.

Langely et al., "Novel ultrawide-bandwidth Vivaldi antenna with low crosspolarisation," Electronic Letters, vol. 23, No. 23, Nov. 11, 1993, pp. 2004-2005.

* cited by examiner

WIDEBAND ANTENNA WITH TRANSMISSION LINE ELBOW

CLAIM OF PRIORITY UNDER 35 U.S.C. §119

In accordance with 35 USC 119(e), this application claims the benefit of U.S. Provisional Patent Application 60/465,664, which was filed on 25 Apr. 2003 in the name of Alireza Hormoz Mohammadian.

BACKGROUND

1. Field

The present invention generally relates to antennas. More particularly, the invention concerns a wideband antenna with a transmission line turn ("elbow") therein.

2. Background

Ever since Guglielmo Marconi demonstrated the transmission and receipt of radio signals in 1895, the world has experienced an inevitable wave of increasingly technical development and profound reliance on wireless communications. Wireless communications have progressed to the point that electromagnetic waves bombard our houses, cities, and planet providing the necessary but invisible links to operate our transistor radios, cell phones, GPS units, cordless phones, walkie talkies, short wave radios, and many other devices. Aside from consumer devices, wireless communications are essential to conducting satellite communications, remotely controlling space vehicles, and operating a dazzling variety of military, industrial, and consumer systems.

Regardless of the shape, size, or frequency band, all wireless devices employ an antenna of some sort. Of course, the shape, size, and design of such antennas vary according to the application. In any case, the antenna is an essential tool in the conversion between electrical signals (suitable for use by electronic circuits) and electromagnetic waves (suitable for transmission over the air).

In the years since 1895, scientists and engineers have developed a tremendous assortment of antennas. A number of these developments have been introduced by QUALCOMM Incorporated, a company that is dedicated to developing wireless communications technologies. In many cases, the antennas introduced by QUALCOMM Incorporated and others have proven satisfactory for their intended applications. Nonetheless, engineers are still committed to further improving various antenna designs related to present and future business. In this context, the novel antenna of the present disclosure is introduced.

SUMMARY

An antenna includes two conductive plates having a radiating end and a feed end. The plates include partially overlapping edges that flare away from each other as each edge progresses toward the radiating end. A dual conductor microstrip feed is also provided. A transmission line connects each plate to a different conductor of the microstrip feed. The transmission line comprises two substantially overlapping, parallel conductive ribbons forming an elbow with a prescribed turn.

DETAILED DESCRIPTION

The nature, objectives, and advantages of the invention will become more apparent to those skilled in the art after considering the following detailed description in connection with the accompanying drawings.

Hardware Components & Interconnections

Antenna Example

Figure 1:
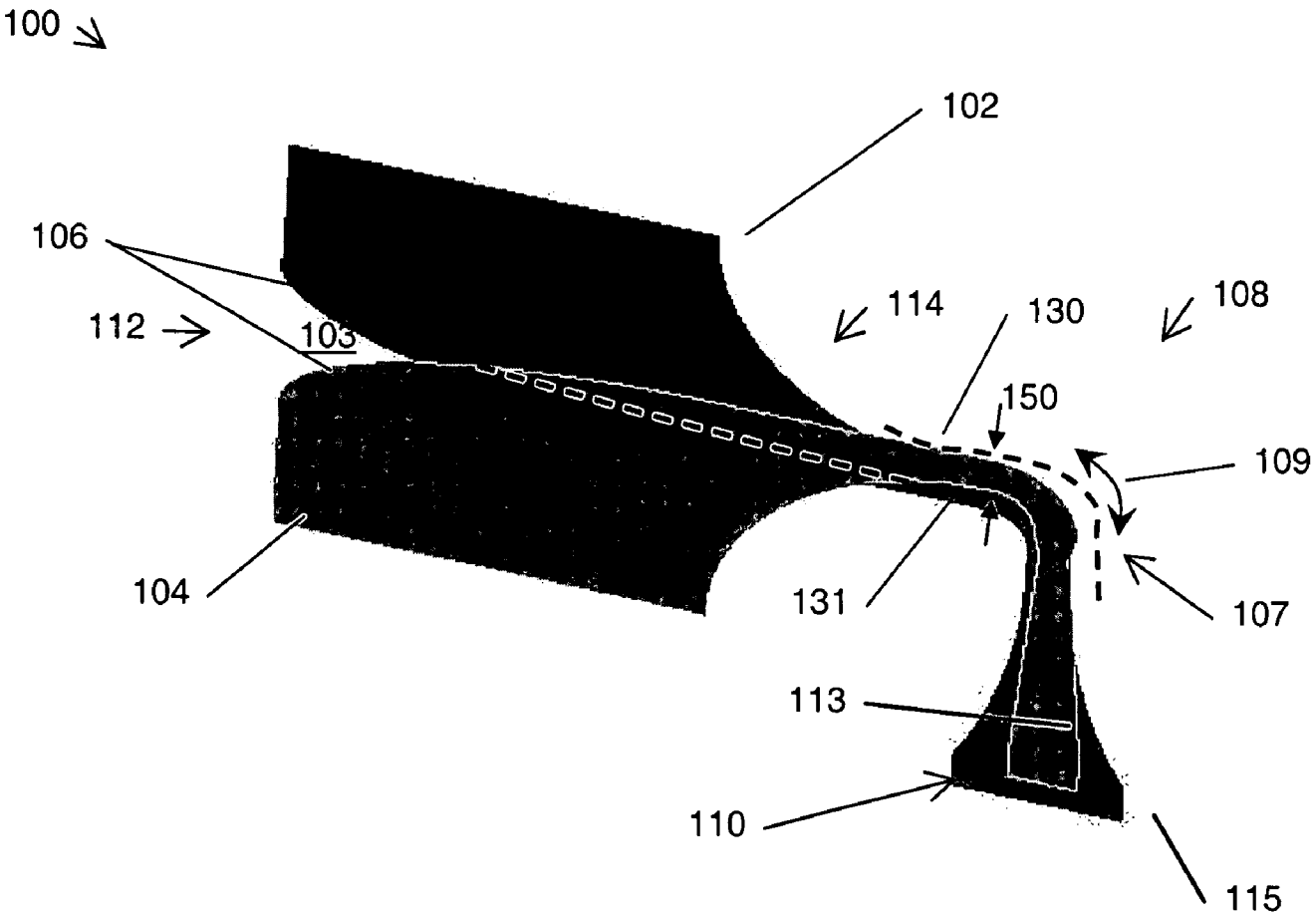
FIG. 1 is a perspective view of an antenna with a transmission line elbow.

FIG. 1 shows one embodiment of antenna according to the present disclosure. The antenna 100 includes two partially overlapping conductive plates 102, 104. The plates 102, 104 have a radiating end 112 and a feed end 114. Facing edges 106 of the plates flare away from each other as each edge progresses toward the radiating end 112. This forms a smooth, flared opening 103 between the plates, facing the radiating end 112.

The plates 102, 104 may also be referred to as poise and counterpoise, or vice versa. Moreover, the plates 102, 104 may be referred to as dipoles. The antenna is antipodal because, in operation, the two plates carry opposite currents.

The plates 102, 104 may be manufactured from a variety of different conductive materials, many of which are already well known to those skilled in the relevant art. As a more specific example, plates may be made out of sheet metal, or by etching two-sided conductive clad applied to a printed circuit board (PCB) material. To cite an even more specific example, the plates 102, 104 may be made of Copper plated with Gold or another anticorrosive substance.

The plates 102, 104 are spaced to accommodate a dielectric material between them. One example is air. Alternatively, a solid dielectric material may be applied between the plates during manufacturing, which also serves to fix the inter-plate distance and support the plates in areas where this dielectric contacts the plates. Many known dielectric materials may be utilized in this application as will be apparent to those of ordinary skill in the art (and having the benefit of this disclosure). One specific example is a PCB material such as FR4 or another glass fiber epoxy laminate.

At their feed end 114, the plates 102, 104 are flared down to provide a smooth transition to a relatively narrow transmission line 108, which connects the plates 102, 104 to a microstrip feed 110. As illustrated, the transmission line 108, also referred to as twin line or twin pair, flares outward as it meets the relatively wider microstrip feed 110. Under a different embodiment than the illustrated example, the transmission line may flare inward as it meets a relatively narrower microstrip feed. The feed 110 includes two conductors 113, 115, where the larger conductor 115 acts as a ground plane. The design, materials, theory, manufacture, and other aspects of microstrips are well known to those of ordinary skill in the relevant art.

The transmission line 108 includes two ribbon shaped extensions of the plates 102, 104 that proceed to and connect with respective conductors of the microstrip feed 110. In the illustrated example, one ribbon 130 is electrically coupled to the microstrip conductor 113, and the other ribbon 131 is electrically coupled to the microstrip conductor 115. In this example, the ribbons 130–131 are laid out in parallel, so that they are substantially overlapping.

Together, the ribbons undergo a turn 109, this region being referred to as an elbow 107. In the foregoing example, the ribbons 130, 131 remain in the same plane (more or less) as they travel between plates 102, 104 and microstrip 110. More technically stated, ribbons 130, 131 at their connection to the plates 102, 104 reside in substantially parallel, overlapping planes. In this context, elbow 107 comprises a region where the ribbons turn in a direction parallel (or within) these planes. Thus, in this embodiment, each ribbon winds to one side like a street turns left or right on an area of relatively flat land. Moreover, the ribbons 130, 131 are synchronized in their movement through the turn 109, maintaining their overlapping relationship. This embodiment may be referred to as the "in-plane" elbow.

Other Examples of In-Plane Elbow

FIGS. 2–5 illustrate several further embodiments of in-plane elbow. Although each drawing illustrates a ninety degree turn, this is only for consistency of illustration and to draw attention to the different configurations of elbow rather than to specifically show angles of turn. This disclosure nonetheless contemplates turns of greater or lesser angles than ninety as needed to suit the application.

Figure 2:
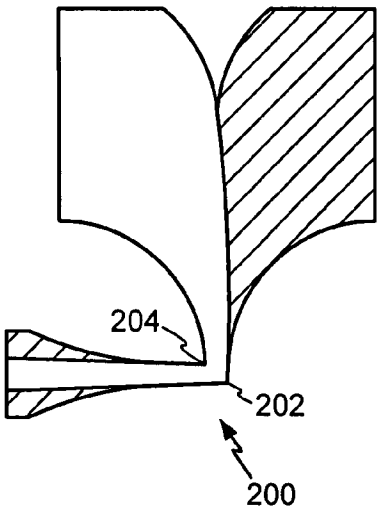
FIGS. 2–6 are plan views of antennas having various configurations of transmission line elbow.
Figure 3:
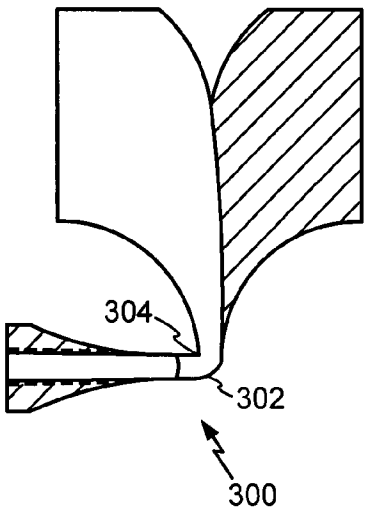
Figure 4:
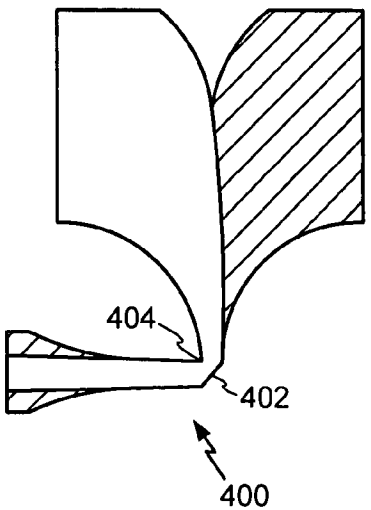
Figure 5:
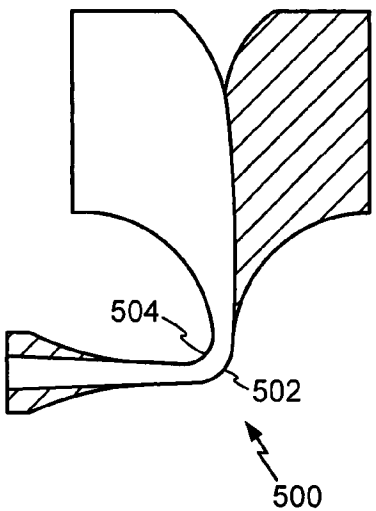

In FIG. 2, angles are formed by the inner 204 and outer 202 edges of the elbow 200. In FIG. 3, there is an elbow 300 with a smoothly curved outer edge 302 and an angled inner edge 304. In FIG. 4, the elbow 400's outer edge 402 has a chamfered shape and the inner edge 404 is angled. Although the use of such edges is foreign to the design of antennas, the ordinarily skilled artisan may obtain assistance in laying out the chamfered shape of FIG. 4 by consulting available teachings regarding circuit boards with circuit traces employing chamfered corners. In FIG. 5, both inner 504 and outer 502 edges of the elbow 500 are smoothly curved.

Orthogonal-Direction Turn Elbow

In contrast with the in-plane elbow bend described above, another embodiment of antenna utilizes a different type of bend. Here, the transmission line ribbons bend orthogonally to the ribbon's broad surface (i.e., its width). This type of bend will be referred to as an "orthogonal-direction" elbow. In one embodiment, this type of elbow is implemented instead of the in-plane bend. In a different embodiment, the orthogonal-direction turn may be implemented in addition to the in-plane bend.

Figure 6:
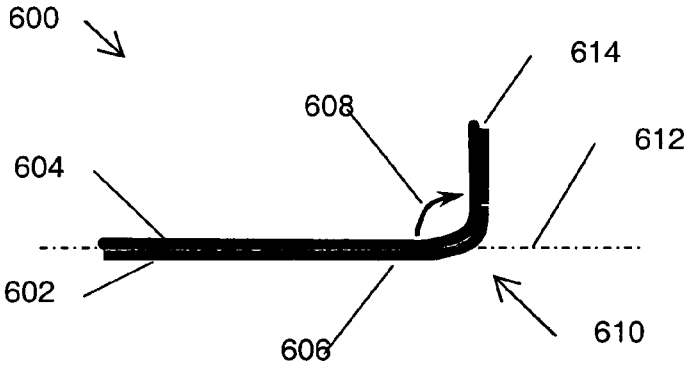

FIG. 6 shows an example of an antenna 600 with an elbow that uses an orthogonal-direction turn. This is a side view, so the plates are shown (by their edges) at 602, 604. The transmission line 610 undergoes a bend 608 between its connection to the plates (at 606) and the microstrip feed 614. More technically stated, the transmission line ribbons at their connection 606 to the plates 602, 604 reside in substantially parallel, overlapping planes (like 612). The elbow is a region where the ribbons turn (608) in a direction perpendicular to that plane 612. Although FIG. 6 illustrates a ninety degree turn, this is merely one example. This disclosure nonetheless contemplates turns 608 of greater or lesser angles than ninety as needed to suit the application.

Elbow Parameters

Utilizing FIG. 1 as an example for discussion purposes, the transmission line 108 may also be referred to as a "balun" since it proceeds between the feed end 114 of the plates (where the flow of current is balanced as between the conductors 130, 131) and the microstrip 110 (where the flow of current is relatively unbalanced between the conductors 113, 115).

Often, it is desirable for an antenna to produce a desired impedance. In the case of a wideband antenna that is expected to operate over a range of frequencies, it may be desirable for the antenna to exhibit a given impedance at a central frequency in the range, where the antenna's impedance does not vary beyond acceptable limits throughout that range.

In the example of FIG. 1, the input impedance of the presently described antenna 100 at the microstrip inputs 113 and 115 is determined by various features of the antenna's construction. More particularly, different features of the flared opening 103, the overlapped regions of 102 and 104, and balun 108 may be established to give a smooth transition of the wave impedance from that of the free space near 103 (approx. 377 ohms) to the a desired source impedance at 113, 115 (fifty ohms, as an example). This helps ensure a wide bandwidth for the antenna.

To provide some specific examples, some features that may be varied to influence impedance include the shape of the elbow (e.g., FIGS. 1–5), radius of the elbow, length of balun undergoing the turn, the width 150 of the transmission line through the elbow, the extent of the overlapped regions of the plates 102, 104, the rate of flare of the plate edges 106 at 103, etc. In the case where some of these features may influence the effects of others, the features are mutually varied as needed to achieve the desired impedance.

In addition to impedance, return loss is another antenna parameter that may be established through design. Initially, the antennas of this disclosure inherently tend to reduce return loss because they exhibit a smooth transition from radiating end to the feed, which also contributes to its wide bandwidth. However, the antenna's return loss may be consciously minimized over a desired bandwidth by appropriately configuring the flare 103, balun 108, and/or other antenna features, using similar techniques as discussed above to set impedance.

Applications

Figure 7:
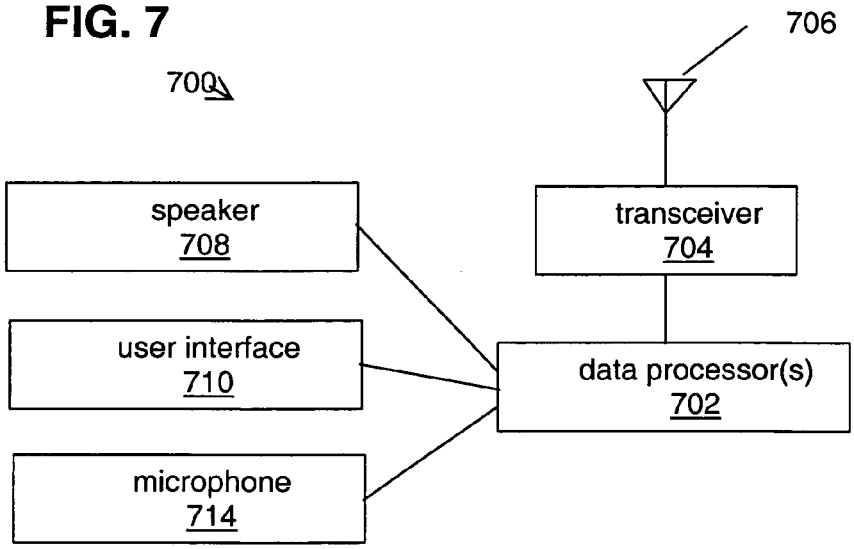
FIG. 7 is a schematic diagram of a wireless telephone.

The disclosed antennas may be utilized in a variety of applications. One example is a wireless phone, with one example being illustrated in FIG. 7. The telephone 700 includes a speaker 708, user interface 710, microphone 714, transceiver 704, antenna 706, and data processor 702, along with any other conventional circuitry (not shown) that may vary depending upon the application. The processor 702 serves to manage operation of the components 704, 708, 710, and 714 as well as signal routing between these components. Some examples of the processor 702 include one or more microprocessors, digital signal processors, discrete circuit elements, logic circuits, application-specific integrated circuits, or other data processing devices. In this example, antenna 706 may be any of the antenna configurations described herein.

Although the wireless telephone 700 is illustrated, this unit may be mobile or stationary. Furthermore, the unit 700 may comprise any data device that communicates through a wireless channel.

In addition to the wireless phone example, there are a variety of other implementations for the antennas of this disclosure. Some of these are described as follows, without any intended limitation whatsoever. One example includes high data rate wireless applications such as ultra wideband communications occurring in the 3–10 GHz frequency band. The disclosed antennas may be used to wirelessly connect components of a computer, network computers, link household devices, wirelessly connect TV receivers to flat screens, connect computers to peripheral devices, collect sensory information and relay it to a processor, etc. And, using the example of FIG. 7, these antennas may be utilized by wireless telephones using CDMA, GSM, WCDMA, TDMA, or another communications protocol.

Figure 8:
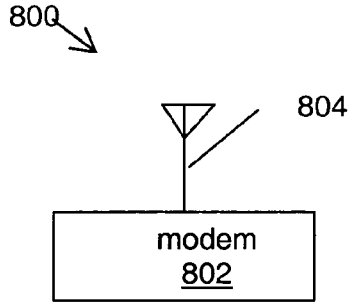
FIG. 8 is a schematic diagram of a modem.

As still another application, an antenna of this disclosure may be produced as part of a modem for installation in a device that would benefit from having wireless communications. To illustrate one example, FIG. 8 shows an antenna 804 with features described by this disclosure, where such antenna is incorporated into a modem 802. The modem 802 may utilize a variety of different designs, and many suitable modems are described in existing publications, commercial products, patents, and other sources available to ordinarily skilled artisans. Such a modem may be permanently or temporarily built into another device, or offered as a standalone unit for removable installation into another product.

Operations

Figure 9:
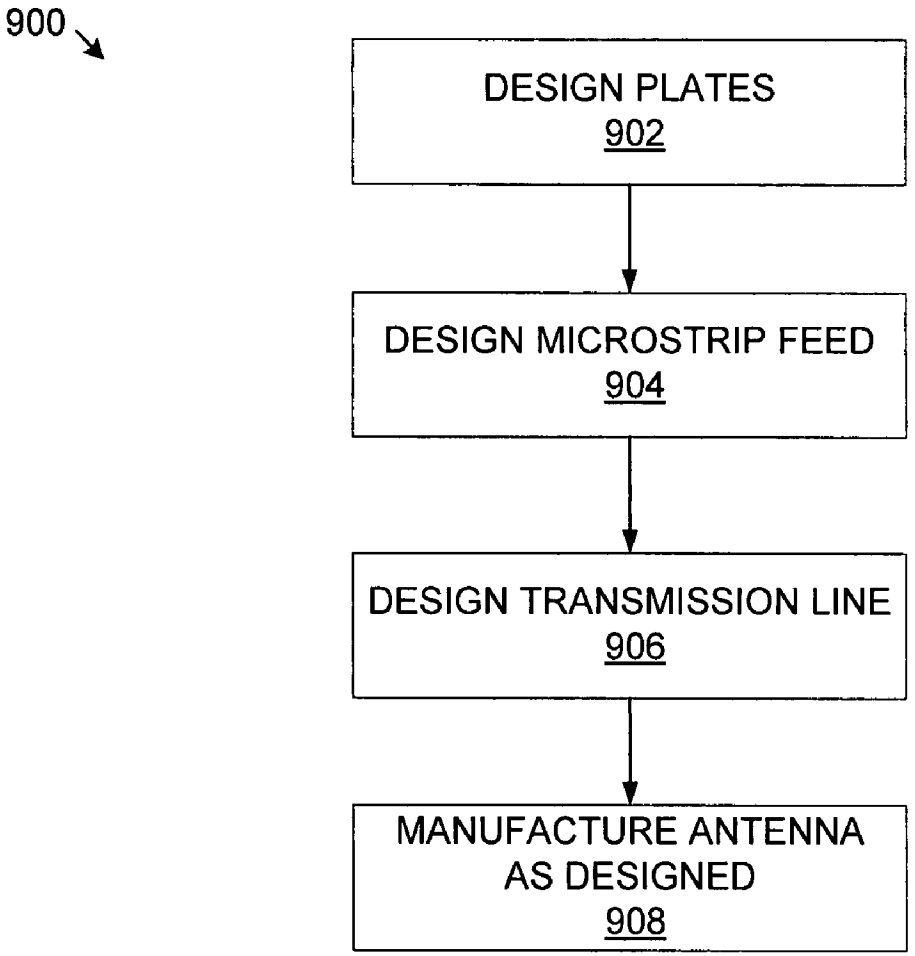
FIG. 9 is a flowchart illustrating operations to design and manufacture an antenna such those depicted in FIGS. 1–6.

Having described exemplary antennas and their structural aspects, the operations of producing such an antenna are now discussed. FIG. 9 depicts one sequence for designing and manufacturing any of the antennas described herein. Without any intended limitation, the sequence 900 is discussed in the context of the exemplary antenna 100 of FIG. 1 in order to provide meaningful references to a specific product that has already been discussed. For ease of reading, the following discussion utilizes a given order of operations, which is by no means limiting; the operations 900 and their respective sub-operations may be rearranged in any order that makes sense.

In step 902, the size, shape, materials, and construction of two partially overlapping conductive plates 102, 104 as discussed above are designed. In step 904, the designer plans the dual conductor microstrip feed 110 is designed. The operations 902–904 may be performed using techniques, skill, knowledge, tools, principles, and other means that will be apparent to those of ordinary skill in the art (having the benefit of this disclosure).

In step 906, the balun 108 is designed to connect each plate 102, 104 to a different conductor of the microstrip 110. The balun 108, as mentioned above, comprises two substantially overlapping, parallel conductive ribbons, which include a prescribed elbow. Accordingly, the design task of step 906 also includes determining one or more elbow parameters so that the antenna yields a desired impedance and/or return loss. The impedance and return loss may additionally be influenced by design decisions of steps 902, 904. Various antenna characteristics influencing impedance and return loss are discussed in detail above.

Each contiguous piece of plate, balun, and microstrip (for example, the plate 102 and the conductors 131, 115) may be referred to as a metallization. Thus, the presently illustrated design includes two metallizations.

Finally, step 908, the antenna is manufactured as designed in steps 902–906. As one example, this may be carried out by preparing a dielectric substrate (not shown), preparing the conductive plates 102, 104 by applying and etching metallization layers to the substrate, and laying down conductive traces to form the balun and microstrip feed. In the case of the orthogonal-bend design, a flexible dielectric material (such as MYLAR™ or ZYVEX™) is used. These and any other necessary operations are carried out to complete manufacture of the wideband antenna 102 with its transmission line elbow 107. As with the earlier operations, the details of the manufacturing operation 908 will be apparent to those of ordinary skill in the art (having the guidance of this disclosure) without the need to explain any further. Ordinarily skilled artisans are further directed to the following publication to the extent that basic, state of the art, or other helpful teachings will aid the ordinarily skilled artisan in producing the disclosed antennas. Gazit, "Improved design of the Vivaldi antenna," IEE Proceedings, Vol. 135, Pt. H, No. 2 (April 1988).

OTHER EMBODIMENTS

Those of skill in the art understand that information and signals may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof.

Those of skill will further appreciate that the various illustrative logical blocks, modules, circuits, and algorithm steps described in connection with the embodiments disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present invention.

The various illustrative logical blocks, modules, and circuits described in connection with the embodiments disclosed herein may be implemented or performed with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

The steps of a method or algorithm described in connection with the embodiments disclosed herein may be embodied directly in hardware, in a software module executed by a processor, or in a combination of the two. A software module may reside in RAM memory, flash memory, ROM memory, EPROM memory, EEPROM memory, registers, hard disk, a removable disk, a CD-ROM, or any other form of storage medium known in the art. An exemplary storage medium is coupled to the processor such the processor can read information from, and write information to, the storage medium. In the alternative, the storage medium may be integral to the processor. The processor and the storage medium may reside in an ASIC.

Moreover, the previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

The word "exemplary" is used herein to mean "serving as an example, instance, or illustration." Any embodiment described herein as "exemplary" is not necessarily to be constructed as preferred or advantageous over other embodiments.

What is claimed is:

1. An antenna, comprising:

two conductive plates having a radiating end and a feed end, the plates including partially overlapping edges that flare away from each other as each edge progresses toward the radiating end;

a dual conductor microstrip feed;

a transmission line connecting each plate to a different conductor of the microstrip feed, the transmission line comprising two substantially overlapping, parallel conductive ribbons forming an elbow with a prescribed turn, wherein the ribbons at their connection to the plates reside in substantially parallel planes, and wherein the elbow comprises a region where the ribbons turn in a direction perpendicular to the planes.

2. The antenna of claim 1, wherein the ribbons also turn in a direction substantially parallel to the planes.

3. The antenna of claim 2, where the elbow includes angled outer and inner edges.

4. The antenna of claim 2, where the elbow includes a chamfered outer edge.

5. The antenna of claim 2, where the elbow includes an angled inner edge and a rounded outer edge.

6. The antenna of claim 2, where the elbow includes rounded outer and inner edges.

7. The antenna of claim 1, the elbow configured to provide the antenna with a desired impedance, established by one or more of the following elbow characteristics: length of the elbow, radius of the elbow, shape of the elbow, width of the ribbons at the elbow.

8. The antenna of claim 1, the antenna exhibiting a desired impedance established by one or more of the following: length of the elbow, radius of the elbow, shape of the elbow, width of the ribbons at the elbow, extent of overlapped regions of the plates, rate of flare of the edges of the plates.

9. The antenna of claim 1, further comprising a dielectric material residing between the plates.

10. An antenna, comprising:

two conductive plates having a radiating end and a feed end, the plates including partially overlapping edges that flare away from each other as each edge progresses toward the radiating end;

a dual conductor microstrip feed;

a transmission line connecting each plate to a different conductor of the microstrip feed, the transmission line comprising two substantially overlapping, parallel conductive ribbons, the ribbons including elbow means for providing a prescribed turn in the transmission line, wherein the ribbons at their connection to the plates reside in substantially parallel planes, and wherein the elbow means comprise a region where the ribbons turn in a direction perpendicular to the planes.

11. The antenna of claim 10, the elbow means further comprising means for matching impedance of the antenna to a desired value.

12. A method of producing an antenna design, comprising operations of:

designing two conductive plates having a radiating end and a feed end, the plates including partially overlapping edges that flare away from each other as each edge progresses toward the radiating end;

designing a dual conductor microstrip feed;

designing a transmission line connecting each plate to a different conductor of the microstrip feed, the transmission line comprising two substantially overlapping, parallel conductive ribbons forming an elbow with a prescribed turn, wherein the ribbons at their connection to the plates reside in substantially parallel planes, and wherein the elbow comprises a region where the ribbons turn in a direction perpendicular to the planes;

the designing operation establishing at least one of the following elbow parameters so that the antenna yields a desired impedance: length of the elbow, radius of the elbow, shape of the elbow, width of the ribbons at the elbow.

13. The method of claim 12, the designing operation conducted such that the elbow parameters further include at least one of the following non-elbow characteristics: extent of overlapped regions of the plates, rate of flare of the edges of the plates.

14. The method of claim 12, further comprising manufacturing an antenna according to the antenna design.

15. A communications device, comprising:

a modem;

coupled to the modem, and antenna comprising:

two conductive plates having a radiating end and a feed end, the plates including partially overlapping edges that flare away from each other as each edge progresses toward the radiating end;

a dual conductor microstrip feed;

a transmission line connecting each plate to a different conductor of the microstrip feed, the transmission line comprising two substantially overlapping, parallel conductive ribbons forming an elbow with a prescribed turn, wherein the ribbons at their connection to the plates reside in substantially parallel planes, and wherein the elbow comprises a region where the ribbons turn in a direction perpendicular to the planes.

16. A communications device, comprising:

a modem;

coupled to the modem, and antenna comprising:

two conductive plates having a radiating end and a feed end, the plates including partially overlapping edges that flare away from each other as each edge progresses toward the radiating end;

a dual conductor microstrip feed;

a transmission line connecting each plate to a different conductor of the microstrip feed, the transmission line comprising two substantially overlapping, parallel conductive ribbons, the ribbons including elbow means for providing a prescribed turn in the transmission line, wherein the ribbons at their connection to the plates reside in substantially parallel planes, and wherein the elbow means comprise a region where the ribbons turn in a direction perpendicular to the planes.

17. A wireless mobile telephone, comprising:

a transceiver;

a speaker;

a microphone;

a user interface;

one or more data processors coupled to the transceiver, speaker, microphone, and user interface;

an antenna coupled to the transceiver, comprising:

two conductive plates having a radiating end and a feed end, the plates including partially overlapping edges that flare away from each other as each edge progresses toward the radiating end;

a dual conductor microstrip feed;

a transmission line connecting each plate to a different conductor of the microstrip feed, the transmission line comprising two substantially overlapping, parallel conductive ribbons forming an elbow with a prescribed turn, wherein the ribbons at their connection to the plates reside in substantially parallel planes, and wherein the elbow comprises a region where the ribbons turn in a direction perpendicular to the planes.

18. A wireless mobile telephone, comprising:

transceiver means for modulating signals for transmission and demodulating received signals;

speaker means for producing audio output from electrical input;

microphone means for producing electrical output from audio input;

user interface means for receiving user input and providing human-readable output;

means for processing data, coupled to the transceiver means, speaker means, microphone means, and user interface means;

an antenna coupled to the transceiver and comprising:

two conductive plates having a radiating end and a feed end, the plates including partially overlapping edges that flare away from each other as each edge progresses toward the radiating end;

a dual conductor microstrip feed;

a transmission line connecting each plate to a different conductor of the microstrip feed, the transmission line comprising two substantially overlapping, parallel conductive ribbons, the ribbons including elbow means for providing a prescribed turn in the transmission line, wherein the ribbons at their connection to the plates reside in substantially parallel planes, and wherein the elbow means comprise a region where the ribbons turn in a direction perpendicular to the planes.

* * * * *